US005291461A

United States Patent [19]

Boeglin et al.

[11] Patent Number: 5,291,461

[45] Date of Patent: Mar. 1, 1994

[54] ELASTOMER STRUCTURE FOR TRANSDUCERS

[75] Inventors: Richard W. Boeglin, N. Kingstown; Richard J. Weeden, Portsmouth; James R. Sturges, Barrington, all of R.I.

[73] Assignee: Raytheon Company, Lexington, Mass.

[21] Appl. No.: 82,828

[22] Filed: Jun. 25, 1993

Related U.S. Application Data

[63] Continuation of Ser. No. 619,772, Nov. 28, 1990, abandoned.

[51] Int. Cl.[5] ..... H04R 17/00

[52] U.S. Cl. ..... 367/163; 367/159; 367/174; 310/337

[58] Field of Search ..... 367/163, 174, 159, 157; 310/337

[56] References Cited

U.S. PATENT DOCUMENTS 3,274,537 9/1966 Toulis ..... 367/163

*Primary Examiner*—J. Woodrow Eldred

*Attorney, Agent, or Firm*—Donald F. Mofford; Richard M. Sharkansky

[57] ABSTRACT

An elastomer support for a sonar transducer includes a ceramic stack electromechanical driver, a pair of rigid support members, and a pair of elastomer layers disposed between the ceramic stack electromechanical driver and the support members. The elastomer support provides effective mechanical stress reduction in the ceramic stack driver, as well as, a simple, reliable heat dissipation means for the transducer.

7 Claims, 4 Drawing Sheets

ELASTOMER STRUCTURE FOR TRANSDUCERS

This application is a continuation of application Ser. No. 07/619,772 filed Nov. 28, 1990 now abandoned.

BACKGROUND OF THE INVENTION

This invention relates generally to acoustic transducers and more particularly to flextensional underwater acoustic transducers.

As it is known in the art, a flextensional transducer typically includes a high strength oval shaped shell which flexes to propagate acoustic waves in a surrounding seawater medium. An electromechanical driver, disposed within the shell, is fed by an alternating current and expands and retracts in an oscillatory manner upon electrical energization to transmit like motions to end portions of the shell disposed along the major axis of the shell. The dynamic force provided by the expansion of the electromechanical driver exerted on end portions of the shell is superimposed on a static compressive bias on the electromechanical driver and causes shell portions along the minor axis of the shell to flex inward. The subsequent retraction of the electromechanical driver causes the shell portions along the minor axis of the shell to flex outward. This flexing action is repeated in an oscillatory manner to propagate acoustic waves in the surrounding seawater medium. Often, mechanical end blocks are positioned between the end portions of the shell and ends of the electromechanical driver adjacent to such end portions to couple the force provided by the electromechanical driver to the shell. End caps are located at opposite ends of the shell and seal the transducer so that seawater does not enter the shell housing. Generally, a flextensional transducer further includes rigid support members to provide mechanical integrity to the transducer and a central support structure to provide mechanical support to the electromechanical driver and to the end caps. The electromechanical driver may be referred to as a transduction driver of which the input energy is electrical waves or electrical energy, and the output energy is acoustic waves or acoustic energy.

As it is further known in the art, one type of electromechanical driver includes a plurality of piezoelectric ceramic elements disposed in a stack arrangement or assembly. The stack arrangement of the electromechanical driver has a length which, generally, significantly exceeds its width or height and thus the driver is susceptable to lateral bending due to shocks experienced by the transducer, such as in the case of a transducer which is rigidly mounted to a surface ship near which an explosive causes substantial shock waves in the surrounding seawater. While a central support structure is conventionally used to minimize the susceptibility of the stack assembly to potentially damaging shocks experienced by the transducer, it is important that such a support structure not restrict the unrestrained motion of the stack assembly upon electrical energization since such restriction can inhibit the efficiency of the propagation of acoustic energy.

One type of support structure known in the art for providing mechanical support to the stack assembly and to the end caps is an I-beam structure. In using an I-beam central support structure, the stack assembly is essentially divided into two stack portions, with a portion located and adhered, or fastened, to each side of the I-beam central support structure. Thus, the I-beam support structure maintains a first end of each of the stack portions in a stationary position with respect thereto, in order to prevent the transmission of acoustic energy into the rigid support member, such transmission decreasing the efficiency of the transducer.

The occurrence of explosive shock waves can cause substantial lateral forces on the shell. Since the ends of the stack portions adjacent to end portions of the shell will move laterally with such shock wave forces while the ends of the stack portions fastened to the I-beam structure remain stationary, lateral bending of the stack portions may result. Further, relatively high tensile stresses may occur on a convexly bent side of a stack portion in spite of the high compressive bias on the stack portions. High tensile stresses in the ceramic stack may generate cracks in the ceramic material, such cracks potentially resulting in a high electric discharge, or corona, resulting from ionization of the gas trapped within the cracks.

It would thus be desirable to minimize the tendency of the ceramic stack assembly to laterally bend in response to shock waves. This would minimize potential tensile stresses and concomitant damage to the stacks associated with such lateral bending. It would also be desirable to minimize such lateral bending while not inhibiting the unrestrained motion of the ceramic stack and shell which otherwise would affect transducer efficiency.

As it is also known in the art, heat dissipation within the electromechanical driver is a critical performance factor since excessive temperatures may degrade the piezo-electric properties of the ceramic elements of the stack. This would result in reduced transducer efficiency and output capability. Typically, the ceramic assembly must be maintained at a temperature of less than approximately 77° C. in order to provide maximum transducer efficiency and output capability.

Several factors should be considered when addressing the problem of heat dissipation in a transducer. Specifically, the cooling should be accomplished without inhibiting the unrestrained motion of the electromechanical driver and the shell in order to maintain acceptable transducer efficiency. Additionally, the transducer should operate, and therefore be cooled, in multiple physical orientations. Further, ease of manufacturability and servicability should be provided.

As it is known in the art, techniques for heat removal are generally categorized either as convection or conduction techniques. Convection generally refers to the transfer of heat from one location to another by the movement of a transport medium, such as a fluid or air. In conduction techniques, heat generally diffuses through a material substance.

Conventional techniques for heat removal in transducers are natural convection and forced convection. Generally, natural convection in a transducer refers to the transfer of heat by the natural movement of air and forced convection refers to the transfer of heat by the forced movement of air created by a blower or fan. The technique of forced convection may provide adequate cooling; however, the reliability of a remotely located fan is cause for concern. The technique of natural convection is simple and reliable; however, it is generally only suitable for relatively low power applications.

Another convection cooling technique which is suitable for high power operation is evaporative cooling using a fluid with low boiling point and condensing point temperatures. This technique includes the use of a container disposed over the ceramic stack assembly in which wicks connect to all of the ceramic elements in order to transport heat from the elements to the fluid having suitable thermal properties. When the temperature within the ceramic stack assembly rises, the fluid transported on the wicks evaporates, providing the necessary cooling. However, in the case of evaporative cooling, the complexity of the apparatus may decrease reliability. The wicks which carry the fluid have limited fluid carrying capacity with respect to the ceramic stack surface area they contact. This limited capacity may result in non-uniform or decreased effectiveness of the technique, particularly at high operating power levels. Additionally, the capillary action of some wicks may be degraded when the transducer is operated at various physical orientations.

Thus, it would also be desirable to have a structure for cooling a flextensional transducer which is sufficiently simple in order to maintain reliability, manufacturability, and servicability of the transducer. The heat dissipation structure should also be effective at high operating power levels and maintain its effectiveness regardless of transducer orientation.

SUMMARY OF THE INVENTION

In accordance with the present invention, an electroacoustic flextensional transducer having a transduction drive means with a high resistance to lateral bending and having improved heat dissipation capability is provided. A resilient housing includes a shell in which is disposed the transduction drive means having a pair of opposing surfaces. The transducer further includes a support member having a first portion adjacent to a first one of the pair of opposing surfaces of the transduction drive means and a second portion adjacent to the second one of the pair of opposing surfaces of the transduction drive means. Disposed between a portion of the support member and the adjacent one of the pair of opposing surfaces of the transduction drive means is a layer of thermally conductive and electrically insulating material. With such an arrangement, a flextensional transducer is provided which has a thermal dissipation capability suitable for high power operation. The thermal dissipation capability is possible due to the low thermal resistance path provided between the heat generating transduction drive means and the surrounding seawater medium by the layer of thermally conductive and electrically insulating material and the support member. Additionally, the layer of thermally conductive and electrically insulating material provides the transduction drive means, which is conventionally comprised of a stack arrangement of a plurality of piezoelectric ceramic elements, with mechanical support thereby reducing adverse stresses on the stack assembly. The preferred thermally conductive and electrically insulating material is an elastomer and permits unrestrained motion of the transduction drive means thereby minimizing potential energy losses in the driver. Thus, the resulting thermal and mechanical benefits are provided without inhibiting the unrestrained motion of the transduction drive means or the shell or sacrificing efficiency. Further, due to its simplicity, the resulting structure is reliable and inexpensive to manufacture and maintain.

BRIEF DESCRIPTION OF THE DRAWINGS

The foregoing features of this invention, as well as the invention itself, may be more fully understood from the following detailed description of the drawings, in which.

DESCRIPTION OF THE PREFERRED EMBODIMENTS

Figure 1:
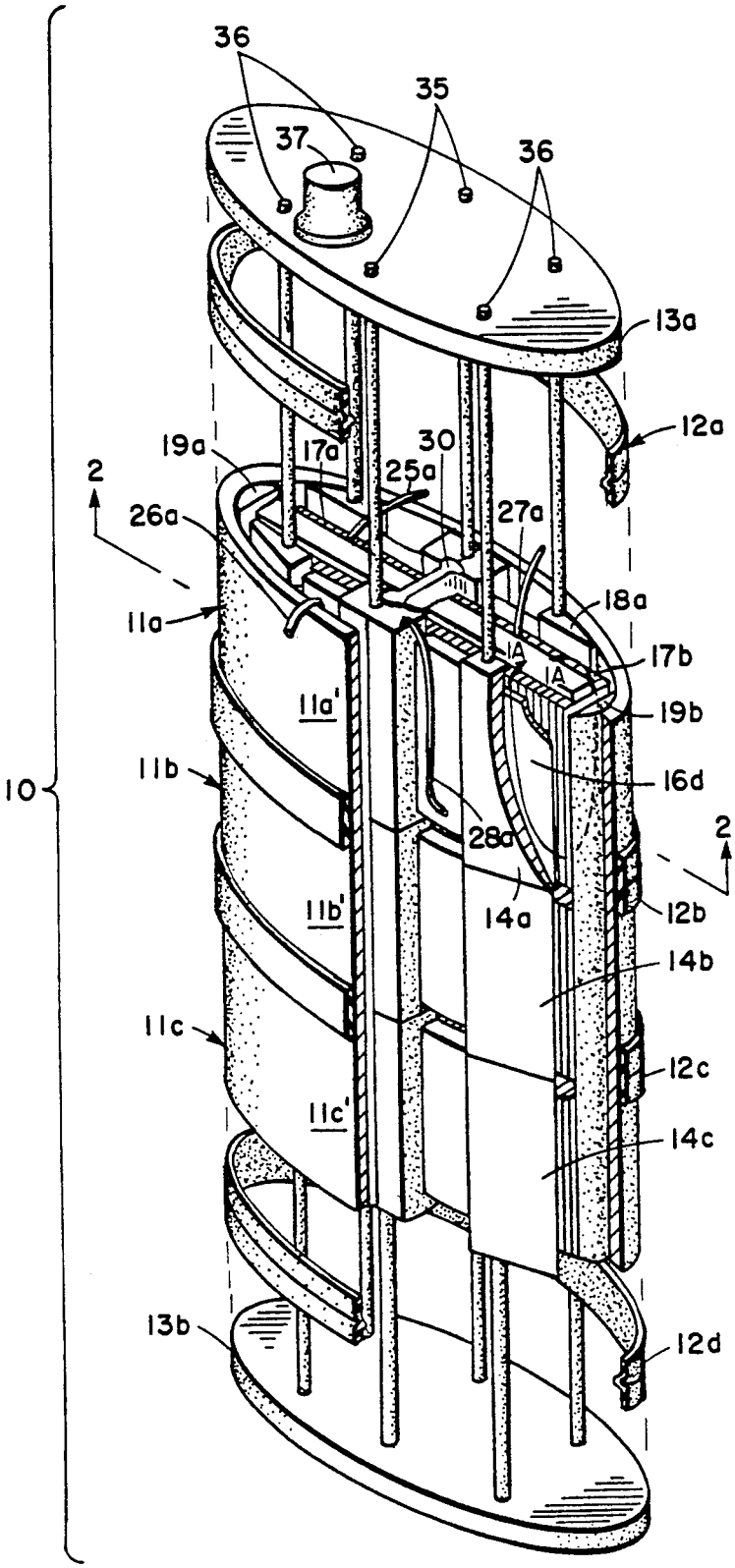
FIG. 1 is an exploded isometric view of a flextensional transducer in accordance with the present invention.
Figure 1A:
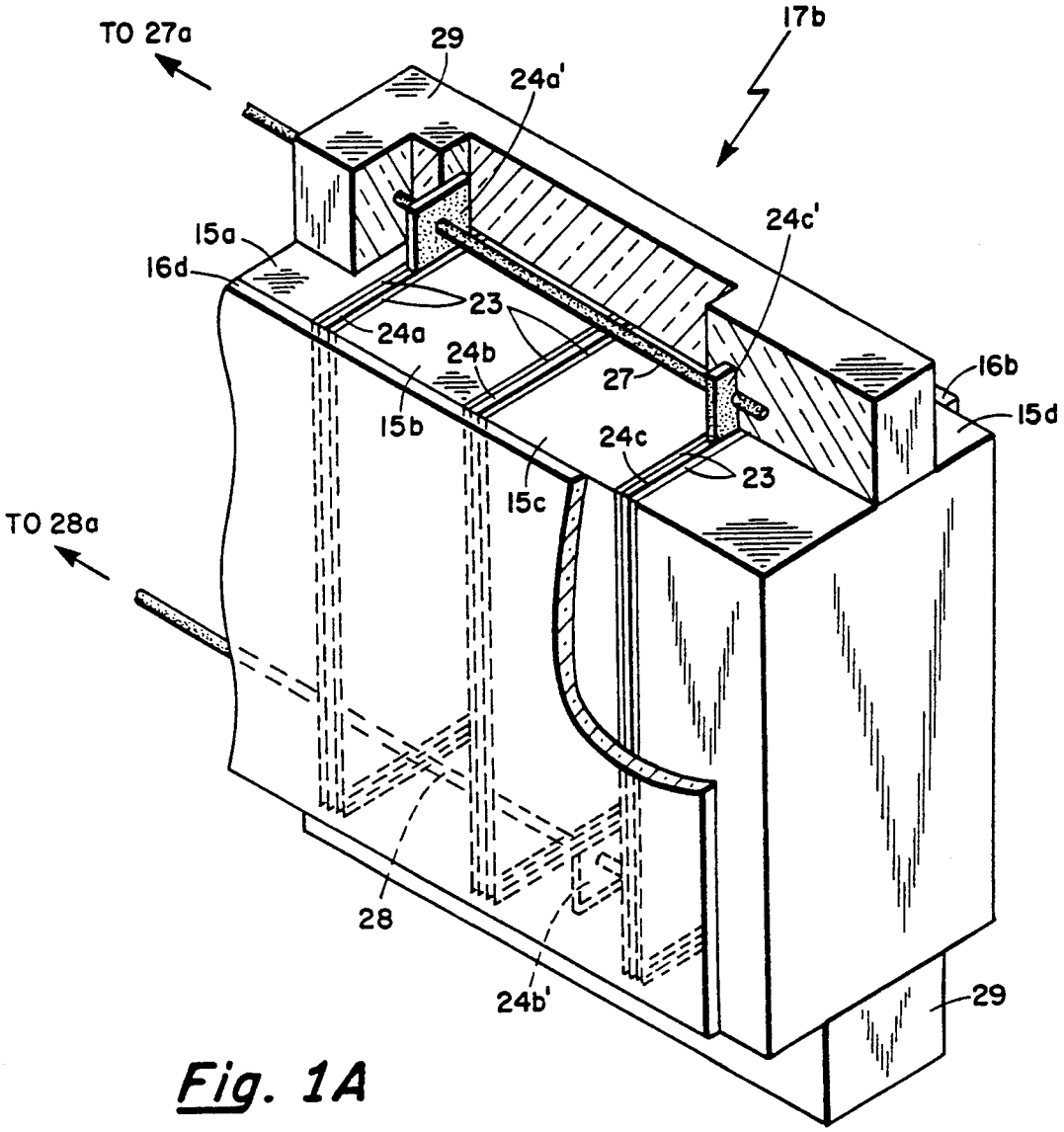
FIG. 1A is a somewhat simplified enlarged view of a portion of the transduction driver and elastomer layer of the flextensional transducer taken along lines 1A—1A of FIG. 1.
Figure 2:
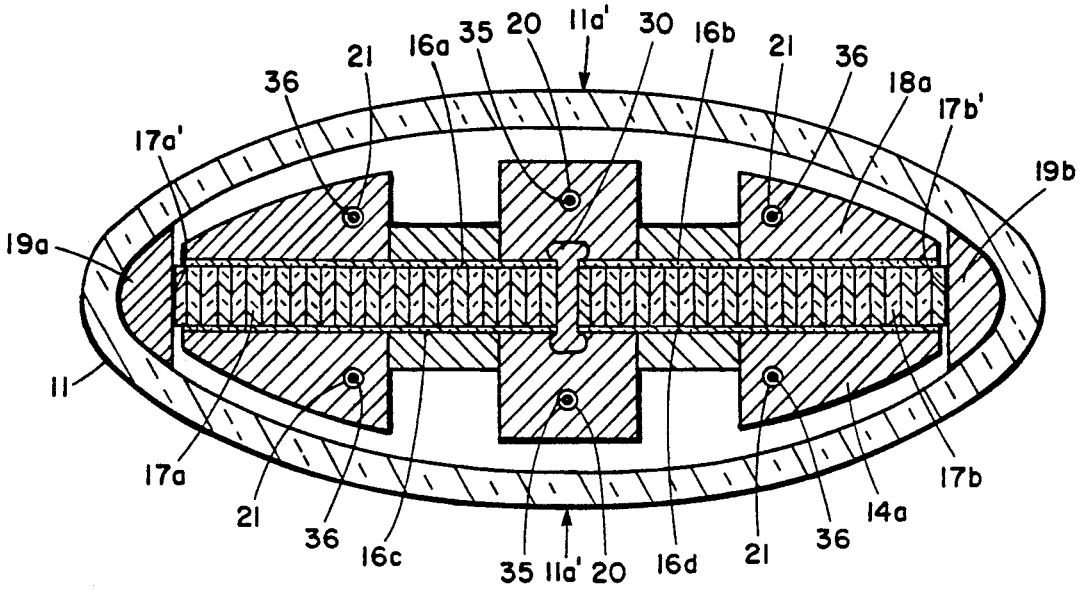
FIG. 2 is a plan view of the flextensional transducer taken along line 2—2 of FIG. 1.

Referring now to FIGS. 1, 1A, and 2, an electroacoustic flextensional transducer assembly 10 includes at least one shell portion, and here three shell portions 11*a*–11*c*, disposed adjacent to one another with gaps between adjacent shell portions 11*a*–11*c* sealed by joint seals 12*b*–12*c*, here comprised of rubber. Other structures for sealing the gaps between adjacent shell portions 11*a*–11*c*, for example an elastomer boot disposed over the entire assembly 10 may alternately be used. The ends of the arrangement of adjacent shell portions 11*a*–11*c* are covered by end plates 13*a*, 13*b* with the gaps between end plates 13*a*, 13*b* and adjacent shell portions 11*a*, 11*c* sealed by joint seals 12*a*, 12*d*, respectively. End plate 13*a* includes a power cable connector 37 through which electrical connections are made to the transducer assembly 10 to energize electromechanical transduction drivers disposed therein, here such drivers including ceramic stack portions 17*a*, 17*b* as will be discussed.

The arrangement of shell portions 11*a*–11*c*, end plates 13*a*, 13*b*, and joint seals 12*a*–12*d*, provides a resilient housing in which is disposed electromechanical transduction drivers. Each shell portion 11*a*–11*c* houses a transduction driver which is comprised of a plurality of piezoelectric ceramic elements disposed in stack arrangements. As shown in FIG. 1, the transduction driver disposed in shell portion 11*a* includes stack portions 17*a*, 17*b*.

Referring now also to FIG. 1A, the construction of an exemplary one of the transduction drivers 17*b* is shown to include piezoelectric ceramic elements 15*a*–15*d* having silver electrodes (not shown) adhered to opposing surfaces of elements 15*a*–15*d*, epoxy layers 23, and beryllium copper foil layers 24*a*–24*c*. Stack portion 17*b* is arranged such that an adjacent two of said ceramic elements 15*a*–15*d* have a like electrical polarity on adjacent surfaces thereof and the silver electrodes of the ceramic elements 15*a*–15*d* are disposed on such adjacent surfaces. For example, adjacent ceramic elements 15*a* and 15*b* have a positive electrical polarity on adjacent surfaces. Disposed between adjacent ceramic elements, 15*a* and 15*b* for example, is a layer of conductive epoxy 23, a layer of beryllium copper foil 24*a*, and another layer of epoxy 23. This arrangement of ceramic elements 15*a*–15*d*, epoxy layers 23, and beryllium copper foil layers 24*a*–24*c* is repeated to form stack portion 17*b*. Epoxy layers 23 adhere the ceramic elements 15a–15d to the beryllium copper foil layers 24a–24c. Beryllium copper foil layers 24a–24c are textured so that such layers 24a–24c contact the silver electrodes of the ceramic elements 15a–15d, even with a layer of epoxy 23 disposed therebetween.

The ceramic stack portion 17b, including ceramic elements 15a–15d, beryllium copper foil layers 24a–24c, and epoxy layers 23, is vacuum impregnated with a urethane coating in order to reduce electric discharge, or corona, potentially caused by the porosity of the ceramic elements 15a–15d. Here, the urethane coating used is sold by Hysol, Inc. of Pittsburg, Calif. under the trademark "HUMISEAL", Product Number 1A20.

Each of the beryllium copper foil layers 24a–24c has a tab 24a'–24c' which extends beyond the stack profile of stack portion 17b and provides a point for electrical connection to the piezoelectric ceramic elements 15a–15d. The tabs 24a'–24c' of consecutive beryllium copper foil layers 24a and 24b or 24b and 24c will have opposite polarities coupled thereto and extend from the stack portion 17b on opposite sides (see FIG. 1A) or alternately, from spaced locations on the same side of stack portion 17b. Buss wire 27 (FIG. 1A) connects tabs 24a' and 24c' extending from the beryllium copper foil layers 24a and 24c on a first, top, surface of stack portion 17b, such tabs being connected to a first, here positive voltage polarity. Buss wire 28 connects tabs 24b' and alternating tabs (not shown) extending from a second, bottom, surface stack portion 17b, such tabs being connected to a second, here negative voltage polarity. Buss wire extensions 25a, 26a, 27a, and 28a (FIG. 1) are electrically connected to buss wires 25, 26, 27, and 28 respectively, here by soldering and extend from such wires 25–28 to the power cable connector 37 of end plate 13a. Here, buss wire extensions 25a–28a are stranded wire.

Thus, to electrically energize stack portions 17a, 17b, each portion 17a, 17b will have coupled thereto two buss wires 25, 26, and 27, 28 respectively. Buss wires 25 and 27 are routed along a first, top surface (FIG. 1) of stack portions 17a, 17b while buss wires 26 and 28 run along the opposite, bottom surface of stack portions 17a, 17b respectively. In order to provide electrical connection points through power cable connector 37, buss wire extensions 26a, 28a (i.e. those that are routed along the bottom surface of stack portion 17b), as well as buss wire extensions providing electrical connection to transduction drivers disposed in shell portions 11b, 11c (not shown) are routed through apertures within support members 14a–14c, as shown in FIG. 1 for buss wire extension 28a.

As shown in FIG. 1A, buss wire 27 and tabs 24a' and 24c' are covered by a suitable potting compound 29. Potting compound 29 is molded to cover buss wire 27 and tabs 24a' and 24c' in order to provide mechanical support for tabs 24a' and 24c' and electrical insulation for tabs 24a' and 24c' and buss wire 27. Potting compound 29 is also used to cover tab 24b' and others (not shown) extending from the second, bottom surface of stack portion 17b.

Upon electrical energization, stack portions 17a, 17b alternately expand and retract concurrently. When the stack portions 17a, 17b expand, opposite ends 17a', 17b' (FIG. 2) of the stack portions 17a, 17b exert force on mechanical end blocks 19a, 19b, which in turn exert force on opposing ends of the shell portions 11a–11c, shown in FIG. 2 for shell portion 11a, along the major axis of the shell portions 11a–11c causing a slight outward expansion. This outward motion of the ends of shell portions 11a–11c causes side portions 11a'–11c' of shell portions 11a–11c, along the minor axis of the shell portions 11a–11c to flex inward and such flexing is repeated to propagate acoustic energy in the surrounding seawater medium.

Also disposed within the housing provided by shell portions 11a–11c are rigid support members 14a, 14b, 14c and 18a, 18b and 18c (FIG. 1) of which 18b and 18c cannot be seen since they are disposed on the backside of transducer assembly 10, under support member 18a and housed by shell portions 11b and 11c respectively. Support members 14a–14c and 18a–18c are here, comprised of aluminum and provide transducer assembly 10 with mechanical support.

As shown, support members 14a and 18a are spaced from ceramic stack portions 17a, 17b and from shell portion 11a so that the expanding motion of stack portions 17a, 17b and the subsequent flexing motion shell portion 11a is not restricted. Support members 14b, 14c, 18b, and 18c are similarly positioned within shell portions 11b and 11c. Support members 14a and 18a, 14b and 18b, and 14c and 18c are mechanically interconnected by a central I-beam support structure 30 disposed therebetween.

Central I-beam support structure 30 provides mechanical support to ceramic sack portions 17a, 17b. The ceramic stack portions 17a, 17b each have a first end adhered to I-beam support structure 30, here with an epoxy; however, alternate methods of adhering or fastening, such as screws, may be used. I-beam support structure 30 has disposed therethrough two apertures 20 (FIG. 2). Here, tie rods 35 (FIG. 1) are disposed through apertures 20 to mechanically couple portions of transducer assembly 10 housed by shell portions 11a–11c together and to end plates 13a, 13b.

Aluminum support members 14a–14c and 18a–18c each have two apertures 21 (FIG. 2) disposed therethrough with each aperture 21 having a tie rod 36 (FIG. 1) further disposed therethrough. In certain applications, it is desirable to have a plurality of transducer assemblies 10 (FIG. 1) coupled together to increase the level of propagated acoustic energy. Here, tie rods 36 are used to mechanically couple a plurality of transducer assemblies 10 together.

In operation, a significant amount of heat is generated in the ceramic stack portions 17a, 17b. Here, each stack portion 17a and 17b can generate up to approximately 250 watts when operating at full power. The transducer assembly 10 (FIG. 1) contains at least one, and up to twenty stack portions or more. For example, the transducer assembly 10 may contain 20 stack portions, with 10 shell portions, thus being capable of generating up to 5000 watts. Such high power levels necessitate efficient heat transfer in order to maintain reliable performance of the transducer assembly 10 since, as previously mentioned, the piezoelectric properties of the ceramic elements of ceramic stack portions 17a, 17b may be degraded when such elements experience excessive temperatures.

Disposed between and in contact with each side of stack portions 17a, 17b and adjacent support members 14a, 14b are layers 16a–16d (FIG. 2) of a thermally conductive and electrically insulating material. The material of layers 16a–16d is thermally conductive to provide an effective heat flow path away from the heat source of the ceramic elements of ceramic stack portions 17a, 17b. The heat flow path provided by layers 16a–16d has relatively low thermal resistance. Layers 16a–16d must also be electrically insulating since there is a high voltage potential difference between ceramic stack portions 17a, 17b and adjacent support members 14a, 18a. The preferred material for layers 16a–16d is an elastomer manufactured by Emerson & Cummings of Canton, Mass., Product No. EC-5019.

In addition to the necessary properties of thermal conductivity and electrical insulation needed for the elastomer material of layers 16a–16d, the material preferably is in the form of a liquid having a relatively low viscosity. The gaps between aluminum support members 14a, 18a and the adjacent surfaces of ceramic stack portions 17a, 17b are approximately 0.25 inches wide. The elastomer, here initially mixed as a liquid, is poured into said gaps and cures at room temperature. Due to the low viscosity of the liquid elastomer, the gaps are effectively filled as opposed to using a relatively viscous material with which air pockets could form in the gap area, such air pockets gaps potentially resulting in a high electric discharge, or corona, resulting from ionization of trapped during pouring and curing, as well as reducing the thermal conductivity. Also, due to the large surface area of stack portions 17a, 17b which contacts layers 16a–16d, the heat dissipation capability of the thermally conductive layers 16a–16d is improved.

Another property of the preferred elastomer material comprising layers 16a–16d is low shear modulus, which permits unrestrained expansion of ceramic stack portions 17a, 17b by effectively decoupling the motion of stack portions 17a, 17b from rigid support members 14a, 18a. Due to the low shearing modulus of elastomer layers 16a–16d, the efficiency of transducer assembly 10 with layers 16a–16d is not measurably degraded over conventional transducers without elastomer layers 16a–16d.

In addition to the heat dissipation merits of elastomer layers 16a–16d, layers 16a–16d can provide sufficient mechanical support for the ceramic stack portions 17a, 17b such that I-beam central support structure 30 may be eliminated for certain applications as will be described in conjunction with FIG. 4. It is believed that since elastomer layers 16a–16d contact a significantly large surface area of stack portions 17a, 17b, such layers 16a–16d will improve the shock suppression capability of transducer assembly 10.

Figure 3:
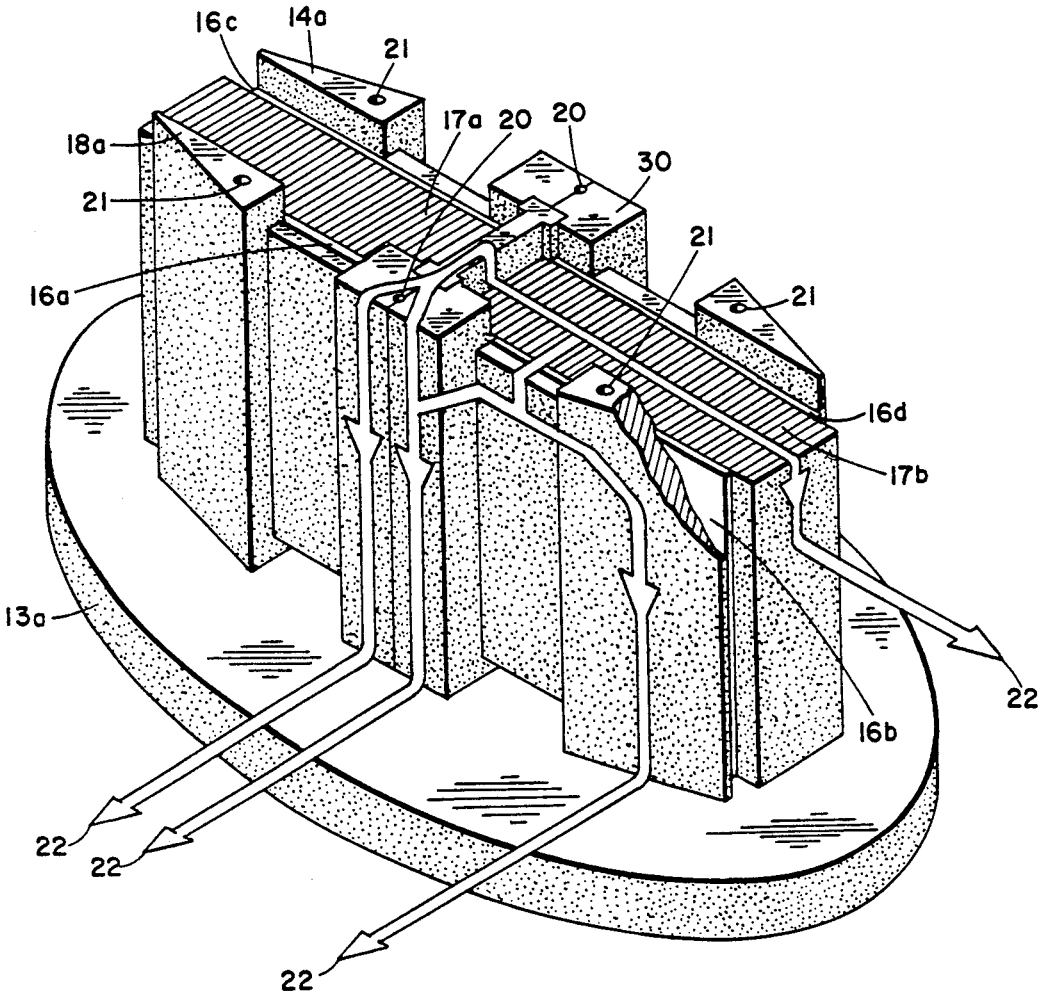
FIG. 3 is an isometric view of a portion of the flextensional transducer of FIG. 1, without electrical connections to the transduction driver, showing exemplary heat flow paths.

Referring now also to FIG. 3, a portion of the transducer assembly 10 of FIG. 1 adjacent end plate 13a is shown without exterior shell portion 11a (FIG. 1) and electrical connections for clarity. The orientation of the portion of transducer assembly 10 of FIG. 3 is shown rotated 180° from that of FIG. 1. In FIG. 3, a heat flow path is shown by arrows 22 extending from the heat source of ceramic stack portion 17b to the external seawater environment. Due to the relatively poor thermal conductivity of ceramic material, only a small percentage of the heat generated in stack portion 17b, in particular, the heat generated in those ceramic elements located closest to the I-beam central support structure 30, will be transferred via support structure 30, to aluminum support member 18a. From aluminum support member 18a, the heat is then transferred to end plate 13a and to the surrounding seawater environment. A substantially larger portion of the heat generated in ceramic stack portion 17b flows along the beryllium copper foil layers 24a–24c (FIG. 1A) disposed between adjacent ceramic elements 15a–15d (FIG. 1A) within the stack portion 17b, and through the thermally conductive elastomer layer 16d, to aluminum support member 18a. The heat is then transferred from aluminum support member 18a to end plate 13a and further, to the surrounding seawater environment. Elastomer layers 16a–16d provide an effective heat flow medium not only due to the thermal conductivity of the material, but also due to the large surface area of the ceramic stack portions 17a, 17b in contact with layers 16a–16d.

Figure 4:
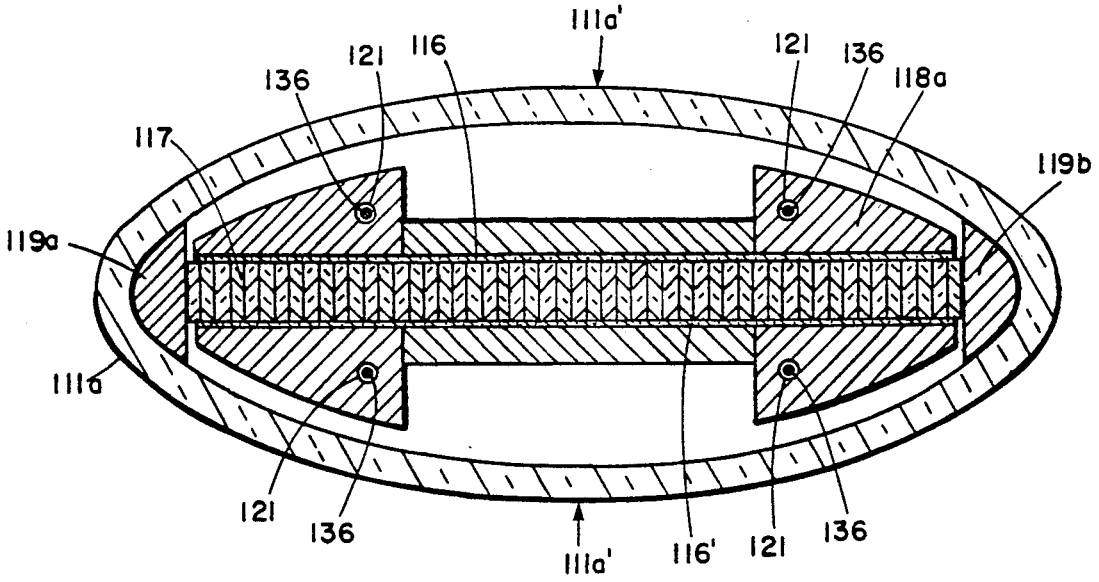
FIG. 4 is a plan view of a flextensional transducer in accordance with an alternate embodiment of the present invention.

Referring now to FIG. 4, an alternate embodiment of the present invention is substantially identical in construction to the transducer of FIG. 2 except that the I-beam central support structure 30 is removed. Elastomer layers 16a and 16b as well as 16c and 16d (FIG. 2) are here continuous layers 116 and 116'. Also, ceramic stack portions 17a, 17b here form a continuous ceramic stack assembly 117 which operates in the same manner described in conjunction with ceramic stack portions 17a, 17b. As previously mentioned, elastomer layers 116, 116' provide mechanical support to the ceramic stack assembly 117, eliminating the need for the mechanical support provided by central I-beam support structure 30 (FIG. 2).

Having described preferred embodiments of the invention, it will now become apparent to one of skill in the art that other embodiments incorporating their concepts may be used. It is felt, therefore, that these embodiments should not be limited to disclosed embodiments, but rather should be limited only by the spirit and scope of the appended claims.

What is claimed is:

1. An electroacoustic transducer comprising:

a resilient housing including a shell portion with an inner surface;

a transduction driver, disposed within said housing, having a pair of opposing end surfaces disposed adjacent the inner surface of the shell portion and further having a pair of opposing side surfaces;

a support member, disposed within said housing, having a surface adjacent to and spaced from one of the pair of opposing side surfaces of the transduction driver; and a layer of thermally conductive and electrically insulating material, disposed between said surface of said support member and said one of the pair of opposing side surfaces of the transduction driver.

2. The electroacoustic transducer as recited in claim 1 wherein the layer of thermally conductive and electrically insulating material is further disposed in contact with the surface of the support member and the one of the pair of opposing side surfaces of the transduction driver.

3. The electroacoustic transducer as recited in claim 1 wherein the thermally conductive and electrically insulating layer is an elastomer.

4. The electroacoustic transducer as recited in claim 1 wherein the thermally conductive and electrically insulating material cures at room temperature.

5. The electroacoustic transducer as recited in claim 1 wherein the transduction driver comprises a first portion and a second portion, the electroacoustic transducer further comprising:

a central support structure disposed between the first portion and the second portion of said transduction driver.

6. The electroacoustic transducer as recited in claim 1 wherein the support member is fabricated from aluminum.

7. The electroacoustic transducer as recited in claim 1 wherein said transduction driver comprises a plurality of ceramic elements with a layer of beryllium copper foil disposed between a first one and a second one of the plurality of ceramic elements and a layer of conductive epoxy disposed between the layer of beryllium copper foil and the first one of the plurality of ceramic elements.

* * * * *